US005435686A

United States Patent [19]

Canner

[11] Patent Number: 5,435,686

[45] Date of Patent: Jul. 25, 1995

[54] BEARING RACE HARDENING LINE

[75] Inventor: Herman M. Canner, Bloomfield Hills, Mich.

[73] Assignee: Sterling Systems, Inc., Royal Oak, Mich.

[21] Appl. No.: 197,740

[22] Filed: Feb. 17, 1994

[51] Int. Cl.[6] ..... F27B 9/18; F27D 3/00

[52] U.S. Cl. ..... 414/152; 414/153; 414/157; 414/156; 414/198

[58] Field of Search ..... 432/124, 125, 126, 162; 198/465.2; 414/152, 153, 156, 157, 161, 172, 173, 187, 196, 198, 210

[56] References Cited

U.S. PATENT DOCUMENTS

| | | | |
|---|---|---|---|
| 1,738,039 | 3/1928 | Cope et al. | 432/126 X |
| 2,084,002 | 9/1935 | Peterson | 432/126 X |
| 3,221,781 | 12/1965 | Forsstrom | 128/465.2 X |
| 4,205,935 | 6/1980 | Edler et al. | 414/152 |
| 4,383,378 | 5/1983 | Lockwood | 432/126 X |

FOREIGN PATENT DOCUMENTS

| | | | |
|---|---|---|---|
| 1116256 | 11/1961 | Germany | 432/126 |
| 1735701 | 5/1992 | U.S.S.R. | 432/125 |

*Primary Examiner*—Michael S. Huppert
*Assistant Examiner*—Stephen Gordon
*Attorney, Agent, or Firm*—Barnes, Kisselle, Raisch, Choate, Whittemore & Hulbert

[57] ABSTRACT

A pusher furnace for heating workpieces has an elongate and generally horizontally extending chamber housing a plurality of trays to receive workpieces thereon to be heated within the chamber. The chamber is divided into at least two generally parallel rows of a plurality of trays and pusher mechanisms are provided adjacent each end of the chamber to push the trays along the rows to circulate them within the chamber. In one embodiment, the chamber is divided into three rows of trays wherein a pusher mechanism alternately transfers work trays from one row to the other rows. Each work tray is provided with a plurality of opposed slots at the upper and lower surface thereof so that work engaging fingers can be inserted into the slots for engaging underneath the workpieces for transfer to and from the furnace.

17 Claims, 3 Drawing Sheets

BEARING RACE HARDENING LINE

FIELD OF THE INVENTION

This invention relates to a device for heating workpieces and more particularly to a pusher furnace to heat and automatically feed workpieces to and from the furnace.

BACKGROUND OF THE INVENTION

Furnaces for heating workpieces in a metal hardening process are known where the workpieces, such as, for example, bearing races are placed on trays and circulated within the furnace. Such furnaces are either of the rotary hearth type which has a turntable with trays loaded with workpieces thereon or an in-line pusher type where the trays loaded with workpieces are advanced by pusher mechanisms along single or parallel rows. In both types of furnaces, it is necessary to remove the trays from the furnace to load and unload the workpieces. Each time a tray is removed, it is subjected to substantial heat loss. Therefore, additional heat is required to heat each tray back to operating temperature once the tray is reloaded with green workpieces and returned to the furnace. The extreme temperature differential subjects the tray to thermal shock reducing the useful life of the tray and requiring more frequent replacement. Additionally, removal, unloading, reloading, and return of the tray increases the open time of the furnace doors resulting in increased heat and atmosphere losses from the furnace interior. Furthermore, unloading a heated workpiece from a tray outside the furnace subjects the workpiece to a longer transfer time outside of the furnace protective atmosphere before being quenched and hence increases detrimental oxidation of the workpiece and can effect the overall cycle time for each tray of parts.

SUMMARY OF THE INVENTION

A pusher type furnace is provided for loading, heating and removing heated workpieces without removing trays from the furnace. An elongated heating chamber has a plurality of preferably parallel rows along which trays loaded with workpieces are circulated by pusher mechanisms. A loading position is located within the chamber at one end of a first row and an unloading position is located within the chamber at an adjacent end of a second row. Each tray is circulated by the pusher mechanisms to be alternately located at the loading position to receive workpieces and at the unloading position where the workpieces are removed from the tray. Workpiece engaging fingers load and unload the workpieces while the trays remain within the chamber. Preferably, each tray is symmetrical end to end and top to bottom and has cut-out portions along the top and bottom surfaces to accommodate the work engaging fingers so that they can engage each workpiece from the underside thereof. If it is desired to use gripper jaws in lieu of work engaging fingers, it is not necessary to provide cut-out portions in the trays.

Additionally, the pusher furnace has less external casing area for the high heat furnace portion of the line than rotary furnaces having the same capacity of workpieces heated per hour. This results in less total heat loss and higher fuel efficiency.

Furthermore, the pusher furnace occupies less total floor space than a rotary furnace for the same production capacity because the rectangular shaped chambers can be more readily grouped with less lost floor space than an equivalent rotary hearth furnace line.

Objects, features and advantages of this invention are to provide a pusher furnace where the trays never leave the heating chamber to be loaded and/or unloaded with workpieces, that reduces heat and atmosphere losses from the furnace interior, lessens the transfer time of the hot workpieces between the furnace and the quench press or other work station, accommodates different size workpieces on the same tray without changing the work engaging fingers, provides trays that are symmetrical and reversible, that is rugged, durable and more efficient, of economical manufacture and assembly, can be transported in one piece, and has a long in service useful life and requires less maintenance and repair.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION

Figure 1:
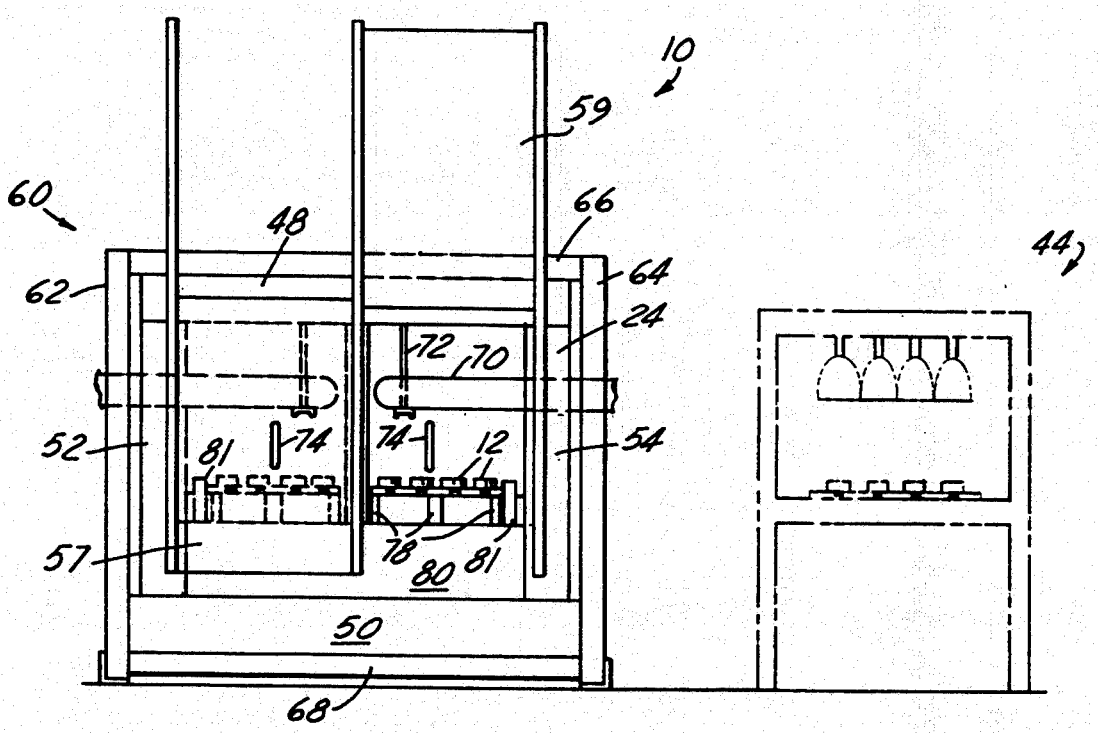
FIG. 1 is a load/unload end view of a pusher furnace of the present invention.
Figure 2:
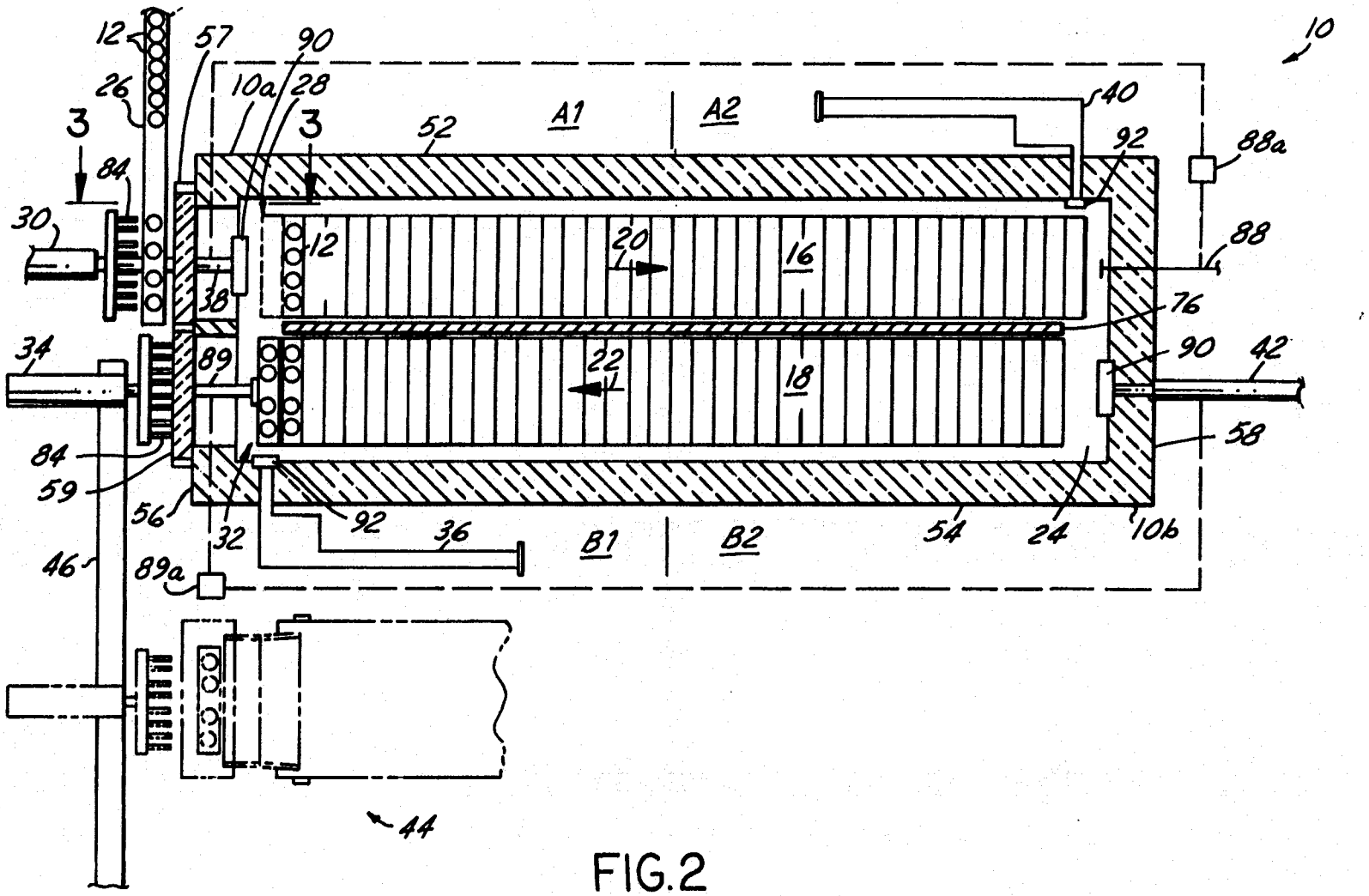
FIG. 2 is a sectional plan view of one embodiment of the pusher furnace of FIG. 1.

Referring in more detail to the drawings, FIGS. 1 and 2 illustrate a pusher furnace 10 embodying this invention for heating to an elevated temperature a plurality of workpieces 12 of the required carbon steel for subsequent quenching to either case harden or through harden them. The workpieces are received on trays 16, 18 disposed in two or more adjacent rows 20 and 22 in a heating chamber 24. Workpieces to be heated are transported from a conveyor 26 onto a tray 16 received in a loading station 28 at the beginning of the first row 20 by a lift and carry transfer mechanism 30. If it is desired to load more than one type (size) part on a tray at a time (i.e., each tray could hold up to four different parts), then a separate loading conveyor would be required for each part. A preload part martialing area would be provided, so all four parts would be picked up at the same time. Heated workpieces are transported from a tray 18 in an unloading station 32 at the end of the second row 22 by a second lift and carry transfer mechanism 34. The trays 16,18 are circulated in the heating chamber 24 by pushers. Empty trays are transferred from the unload station 32 to the load station 28 by a first cross pusher 36, trays of workpieces are advanced along the first row 20 by a second row pusher 38, transferred to the second row 22 by a third cross pusher 40 and advanced along the second row 22 by a fourth row pusher 42.

To rapidly transfer the heated workpieces to a separate work station 44 for quenching them with a liquid, the second lift and carry mechanism 34 is carried by a transporter 46.

The heating chamber 24 extends horizontally, is longitudinally elongate, and defined by a roof 48, floor 50, side walls 52,54, and front and back walls 56,58. The front wall 56 has a loading door 57 and an unloading door 59 both of which are operable, preferably pneumatically, to be quickly opened for loading and unloading the workpieces to and from the heating chamber 24. If desired, the loading door may be located in the sidewall 52 centered at the loading station 28. The walls are supported by a steel casing and frame 60 having a pair of spaced apart longitudinally extending uprights 62,64 fixed and connected together by upper and lower cross ties 66,68. Preferably, the chamber 24 is heated by a plurality of longitudinally spaced part U-shaped heating elements or radiant tubes 70 supported in the chamber by hanger supports 72 suspended from top roof 48. The heating elements 70 extend through the side walls exterior of the chamber 24 to a control (not shown). A thermocouple 74 is provided for each side (zone) of the chamber 24 and is connected to the control. The thermocouples 74 measure the temperature in the zones of the chamber 24 and signals the control of any differential in temperature, thus activating certain of the heating elements 70 to maintain the chamber 24 at a constant temperature. Preferably, the chamber 24 is divided into separate temperature zones A/B by a barrier wall 76 received between the rows 20,22 extending vertically between the roof and floor 48,50. Each of the zones A/B are also zoned along the length of the furnace into zones A1, A2, B1, B2, etc.

As shown in FIG. 1, each tray is supported by three spaced apart longitudinally extending rails 78 on cross support piers 80 in the chamber 24. Guides 81 are provided to guide the tray edges as they are pushed along each row 20,22.

Figure 3:
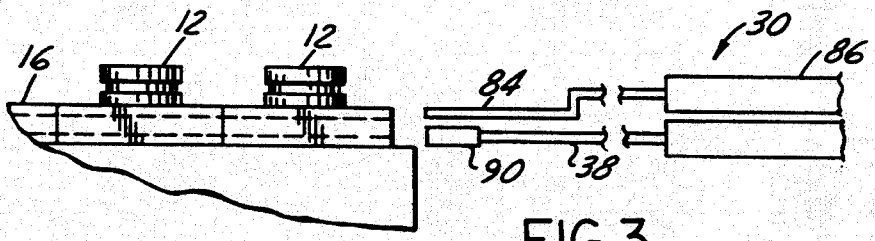
FIG. 3 is a fragmentary schematic view of trays in the furnace taken along line 3—3 in FIG. 2.
Figure 4:
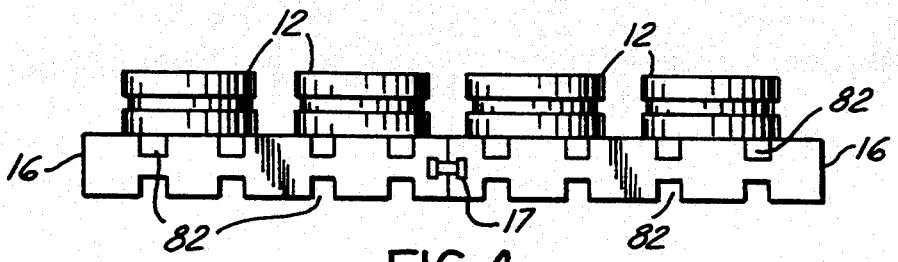
FIG. 4 is a front view of one of the trays with workpieces thereon.
Figure 5:
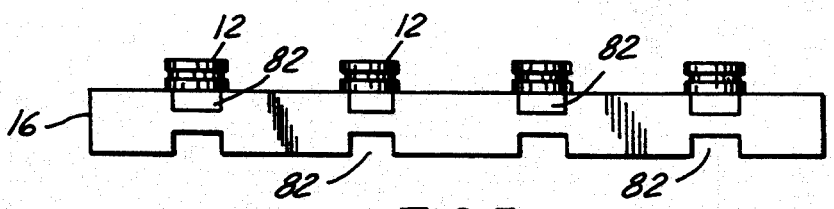
FIG. 5 is another embodiment of a tray with workpieces thereon.

The trays 16,18 are symmetrical and reversible as seen in FIGS. 3–5. Each tray has a dimension related to the size and quantity of work parts it will carry, preferably a $6\frac{1}{2}\times30$ inch tray can accommodate four work parts of a range of parts from 2 to 6 inches in diameter and typically $\frac{3}{8}$ of an inch maximum thickness. Larger trays can carry more parts. Each tray has diametrically opposed slots 82 in the upper and lower surfaces thereof. The trays provide the capability of handling a range of parts without requiring any tool changes. The workpieces can be different diameters and heights for each work tray. For example, FIG. 4 shows a large workpiece 12 centered over two slots 82, whereas FIG. 5 shows a small workpiece 12 centered over one slot 82. The slots 82 are provided in the trays for loading and unloading the workpieces by the lift and carry mechanisms 30,34. Preferably, as seen in FIG. 4, two trays are connected by bolts 17. This provides a longer tray surface without warpage which would occur if the tray was a single continuous piece.

Each lift and carry mechanism 30,34 is positioned adjacent the loading door 57, and the unloading door 59, respectively, and has a plurality of work engaging fingers 84. The work engaging fingers 84 are operable, preferably by a hydraulic motor or electro-mechanical arrangement 86, to engage each of the four workpieces 12 at the same time from underneath thereof, lift the workpieces 12 from the conveyor 26 and extend into the chamber 24 to load and unload the workpieces 12 onto and from the trays. Typically, the slots 82 in each tray are constructed to accommodate two work engaging fingers 84. The number of work engaging fingers designed for each workpiece varies according to the part diameter. For example, large workpieces, as seen in FIG. 4, require four work engaging fingers; whereas, smaller workpieces, as seen, for example, in FIG. 5 require only two work engaging fingers. The lift and carry mechanism 34 is connected to the transporter 46 to move the lift and carry mechanism 34 with unloaded workpieces to the separate work station 44 for quenching.

For certain applications, gripper jaws can be employed (not shown) to grab the outside diameters of the workpieces. This method decreases the transfer time of the parts to the quench press and allows a more simple method of centering the workpieces in the press.

Referring now to FIG. 2, it can be seen that the first, second, third and fourth pusher mechanisms 36,38,40,42 are provided at each end of the furnace 10 to circulate the trays 16,18 within the furnace 10. Pushers 36,40 are of the type known as stiff chain pushers and are located within the walls 52,54 at the opposite ends **10*a*,10*b* of the furnace 10 to cross push the trays located at the ends of each row 20,22 to the opposite row. The tray-engaging ends 92 of the first and third pushers 36,40 are narrow so as to engage only one tray at a time as it is moved across from one row to the other. The stroke of each pusher 36,40 is controlled by a limit switch that has been preset to locate the trays at the desired position at the end of each row 20,22. Pushers 38,42 are typically rod pushers and are located within walls 56,58 at the ends 10*a*, 10*b* of the furnace 10 for moving the loaded trays 16,18 along rows 20,22. A tray locator 88 is located at the end 10*b* of row 20 for abutment with each tray that reaches the end 10*b* of row 20. Similarly, a tray locator 89 is located at the end 10*a* of row 22 for abutment with each tray that reaches the end of row 22. The tray locators 88,89 control the stroke length of pushers 38,42, respectively, through a position sensor 88*a*,88*a*. Each position sensor 88*a*,89*a* sends a signal to the pusher 38,42, respectively, when the tray reaches a predetermined position at the end of the row. This signal terminates operation of each pusher 38,42. These pusher mechanisms are preferably electro-mechanically operated and are constructed so that only the tray-engaging end of the pushers extend into the chamber. The tray-engaging ends 90 of the second and fourth pushers 38,42 are elongated to engage each tray substantially along its length as it is pushed squarely along the rows 20,22**.

A loading station 28 is provided within the heating chamber 24 at the end of row 20 adjacent the loading door 57. This position allows an empty tray to be loaded with workpieces while remaining within the heating chamber 24. An unloading station 32 is located at the end **10*a* of row 22 adjacent the loading station 28. The unloading station 32 is adjacent the unloading door 59 and allows for workpieces 12 on a loaded tray to be unloaded while the tray remains within the heating chamber 24**.

Additionally, further access to the chamber 24 may be provided, such as by maintenance doors (not shown) provided at the end of the furnace 10 in wall 54 directly across from cross pusher 40. An additional maintenance door may be provided at the end **10*a* of the furnace 10 in wall 52 directly across from cross pusher 36. These doors provide access to the chamber 24** and for easy removal and inspection of the trays for cracks, warping, and other damage, during maintenance shutdowns.

Furthermore, a two-tier tray arrangement (not shown) with the upper tray physically sitting on and supported by the lower tray may be provided in the furnace wherein each row 20,22 has an upper and lower set of trays, and are moved within the furnace chamber in the same manner as the single trays. This arrangement will increase the capacity of the furnace when it is used for longer furnace cycles, like carburizing.

It can thus be seen that in the furnace of FIG. 2, the workpieces 12 are fed to the end 10*a* of the furnace 10 by the conveyor 26. The lift and carry mechanism 30 is then actuated so that the work engaging fingers 84 pick up or lift the workpieces 12 from the conveyor 26. The loading door 57 is then momentarily opened and the work engaging fingers 84 with the workpieces 12 are extended into the heating chamber 24. The work engaging fingers 84 disengage the workpieces and are received in the slots 82 in an empty tray 16 at the loading station 28 to load the workpieces 12 onto the tray. The work engaging fingers 84 are then retracted and the loading door 57 closed. The tray locator 88 is extended into the position that will eventually be occupied by the last tray in row 20. The row pusher 38 is then actuated to push the trays along row 20 until one of the trays abuts the tray locator 88. The row pusher 38 continues to move the trays along row 20 as the last tray in that row pushes back the tray locator 88. This movement continues until the tray locator 88 is pushed a predetermined distance that is sensed by position sensor 88*a* to accurately locate the tray at the end of row 20. The position sensor 88*a* then sends a signal to stop the row pusher 38. Both the row pusher 38 and tray locator 88 are then withdrawn. The cross pusher 40 is then actuated to move the tray from the end of row 20 across to row 22.

Once a tray has been moved into row 22, and in sequence with the furnace cycle, the row pusher 42 is actuated to push the trays along row 22 toward the end 10*a* of the furnace 10 until one of the trays abuts the tray locator 89. Tray locator 89 is pushed a predetermined distance sensed by position sensor 89*a* which signals the row pusher 42 to stop. A tray is now accurately positioned at the unloading station 32. Cross pusher 36 is also initiated for a short tray positioning stroke to locate the tray laterally for unloading.

At this time, the tray located at the unloading station 32 is unloaded. The unloading door 59 is opened and the work engaging fingers 84 extended into the heating chamber 24. The work engaging fingers 84 enter the slots 82 in the tray to engage the workpieces 12 from underneath. The work engaging fingers 84 remove the workpieces 12 from the tray, out of the heating chamber 24 and the transporter 46 carries the work parts to work station 44. The unloading door 59 is then closed.

The cross pusher 36 is then actuated to extend a predetermined distance as set by its limit switch to push the empty tray into the loading station 28 where it is loaded as previously described.

Figure 6:
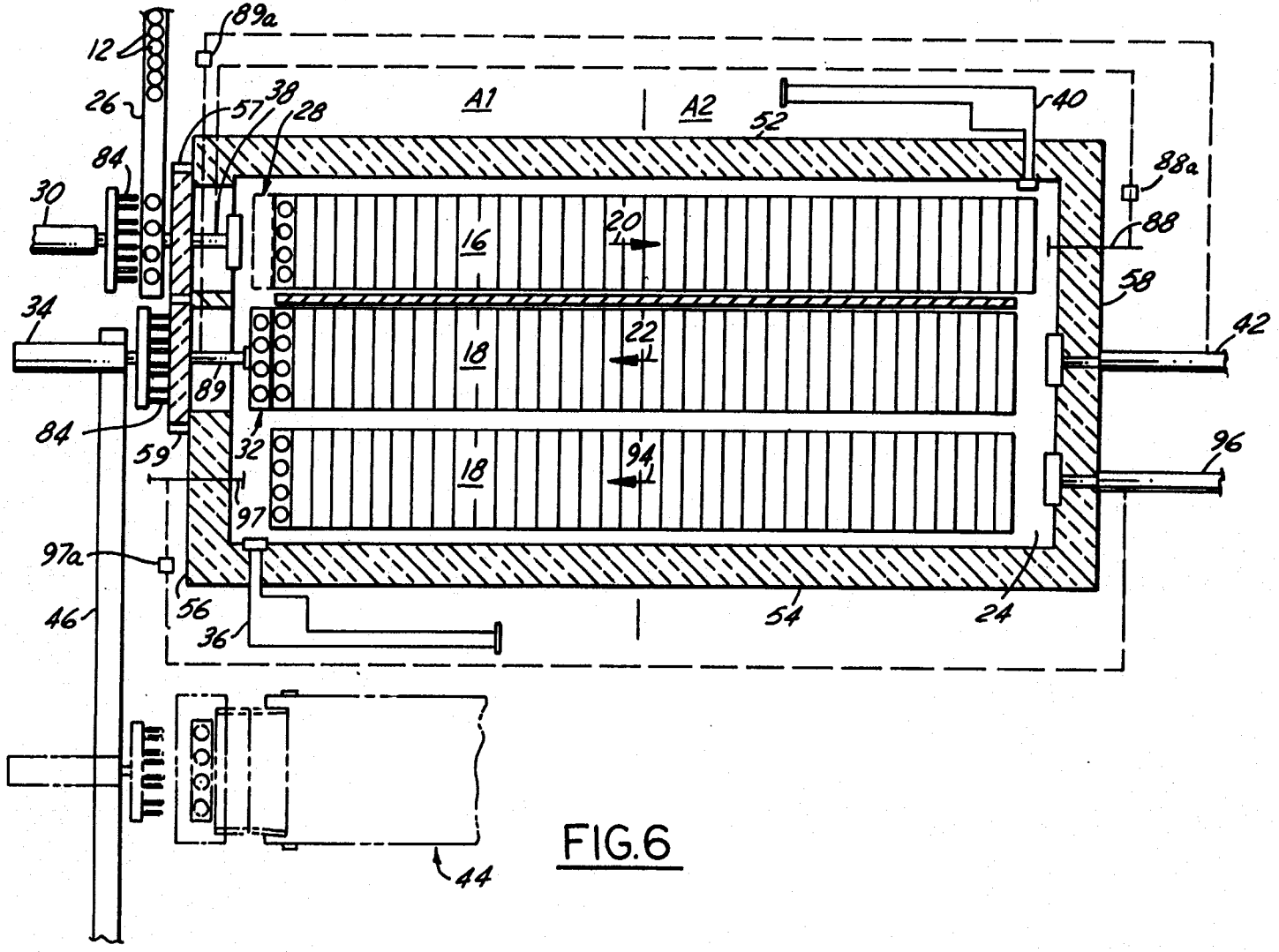
FIG. 6 is a sectional plan view of another embodiment of the pusher furnace.

FIG. 6 shows another embodiment of a pusher furnace similar to the pusher furnace of FIG. 2 wherein like reference numerals represent like parts. In this embodiment, return row 94, row pusher 96 and tray locator 97 are added so that the trays 16 are fed from the first row 20 alternately to return rows 22 and 94. This increases the residence time of the workpieces in the furnace which is desirable for longer furnace cycle times such as for carburizing workpieces. For example, if the workpieces 12 are in the first row 20 for approximately one hour, whereafter, each tray 16 will then be transferred to either row 22 or 94. The approximate time the workpieces 12 spend in each row 22,94 will be two hours to allow the workpieces 12 to be carburized.

The operation of the furnace of FIG. 6 is substantially the same as that shown in FIG. 2 wherein workpieces 12 are advanced along row 20 by the row pusher 38. However , as soon as a tray reaches the end of row 20, cross pusher 40 is actuated to laterally move the tray across to one of either row 22 or row 94. The cross pusher 40 feeds trays alternately to row 22 and row 94, respectively. Row pushers 42,96 are then operated in sequence with the furnace cycle to move the trays along rows 22 and 94 in the direction of the arrows until they reach the end of each row. As soon as the tray at the unloading station 32 is unloaded and moved across to the loading station 28, the row pusher 96 is actuated, in sequence with the cycle, to move the trays along row 94. These trays are advanced in the same manner as the trays in row 22. When a tray abuts tray locator 97, the tray locator 97 is pushed back a predetermined distance sensed by position sensor 97*a*. The position sensor then sends a signal to the row pusher 96 to stop. The row pusher 96 and tray locator 97 are then retracted. The tray at the end of row 94 is now accurately positioned to be moved across to the unloading station 32 where it is unloaded. The empty tray is further moved to position 28 for loading. Row pusher 38 moves all trays forward in row 16. The process is then repeated.

Thus, it can be seen that the pusher furnace of the present invention circulates the workpieces without removing the trays from the heating chamber. This reduces heat and atmosphere losses from the furnace and lessens the transfer time of the workpieces from the furnace to a separate work station.

What is claimed is:

1. A pusher furnace for heating workpieces comprising:

an elongate and generally horizontally extending chamber, plurality of trays for receiving workpieces being heated and located within said chamber, a first row of a plurality of the trays in edge abutting relationship and extending longitudinally in the chamber from one end to the other end of the first row, at least one second row of a plurality of the trays in edge abutting relationship extending longitudinally of the chamber from one end to the other end of the at least one second row and adjacent to and generally parallel with the first row of trays, a first pusher adjacent said one end of said first row for intermittently advancing substantially in unison all of the trays in said first row toward the other end thereof, a second pusher adjacent said other end of said first row for intermittently transferring trays from the first row to said at least one second row, a third pusher adjacent said other end of said at least one second row for intermittently advancing substantially in unison all the trays of said at least one second row toward the one end thereof, a fourth pusher adjacent said one end of said at least one second row for intermittently transferring trays from said at least one second row to said first row, a loading opening for horizontal entry into said chamber adjacent said one end of said first row of trays, a loading door for opening and closing said loading opening into said chamber, an unloading opening for horizontal exit from said chamber adjacent said one end of said at least one second row of trays, an unloading door for opening and closing said unloading opening from said chamber, an actuator for opening and closing said loading and unloading doors, for loading and unloading workpieces from the trays, a workpiece loader outside the chamber and immediately adjacent said one end of said first row for engaging, lifting and carrying at least one workpiece to be heated horizontally through the loading opening when said loading door is open and placing the workpiece on an empty tray in the chamber and while such tray remains within the chamber, and a workpiece unloader outside the chamber and immediately adjacent said one end of said at least one second row for engaging, lifting and carrying horizontally at least one heated workpiece from a tray within the chamber and removing the workpiece from the chamber horizontally through the unloading opening when said unloading door is open and while such tray remains within the chamber.

2. The pusher furnace of claim 1 which comprises two said second rows of trays generally parallel to each other and said first row of trays, said second pusher alternately transfers trays from said first row to one and then the other of said second rows, and said fourth pusher alternately transfers trays from one and then the other of said second rows to said first row.

3. The pusher furnace of claim 2 wherein the chamber also comprises a barrier disposed generally parallel to and between said first row and said second rows of trays to facilitate heating of workpieces carried by the trays and for separation of atmospheres from one side of the barrier to the other.

4. A pusher furnace for heating workpieces comprising:

an elongate and generally horizontally extending chamber, a plurality of trays for receiving workpieces being heated and located within said chamber, a first row of a plurality of the trays in edge abutting relationship and extending longitudinally in the chamber from one end to the other end of the first row, at least one second row of a plurality of the trays in edge abutting relationship extending longitudinally of the chamber from one end to the other end of the at least one second row and adjacent to and generally parallel with the first row of trays, a first pusher adjacent said one end of said first row for intermittently advancing substantially in unison all of the trays in said first row toward the other end thereof, a second pusher adjacent said other end of said first row for intermittently transferring trays from the first row to said at least one second row, a third pusher adjacent said other end of said at least one second row for intermittently advancing substantially in unison all the trays of said at least one second row toward the one end thereof, a fourth pusher adjacent said one end of said at least one second row for intermittently transferring trays from said at least one second row to said first row, a workpiece loader outside the chamber and immediately adjacent said one end of said first row for horizontal entry for loading at least one workpiece to be heated onto an empty tray in the chamber and while such tray remains within the chamber, a workpiece unloader outside the chamber and immediately adjacent said one end of said at least one second row for engaging and removing horizontally at least one heated workpiece from a tray within the chamber and while such tray remains within the chamber, and each tray has an upper surface and a lower surface, and a plurality of diametrically opposed evenly spaced slots in said upper and lower surfaces to accommodate said workpiece loader and said workpiece unloader.

5. The pusher furnace of claim 4 comprising:

a loading door adjacent said one end of first row of trays, an unloading door adjacent said one end of said at least one second row of trays, and an actuator for opening and closing said loading and unloading doors for loading and unloading workpieces from the trays.

6. The pusher furnace of claim 1 wherein said workpiece loader also comprises at least one finger constructed and arranged to be received under one of the workpieces for lifting and carrying the workpiece for loading the workpiece on an empty tray within the chamber.

7. The pusher furnace of claim 1 wherein said workpiece loader also comprises at least one first finger receivable under one of the workpieces for lifting and carrying the workpiece into the chamber and depositing the workpiece on an empty tray within the chamber, and the workpiece unloader also comprises at least one second finger receivable under a heated workpiece on a tray within the chamber for lifting and carrying the heated workpiece from the tray while such tray remains within the chamber.

8. The pusher furnace of claim 4 wherein said workpiece loader also comprises at least one finger constructed and arranged to be received under one of the workpieces for lifting and carrying the workpiece for loading the workpiece on an empty tray within the chamber.

9. The pusher furnace of claim 4 wherein said workpiece loader also comprises at least one first finger receivable under one of the workpieces for lifting and carrying the workpiece into the chamber and depositing the workpiece on an empty tray within the chamber, and the workpiece unloader also comprises at least one second finger receivable under a heated workpiece on a tray within the chamber for lifting and carrying the heated workpiece from the tray while such tray remains within the chamber.

10. The pusher furnace of claim 4 which comprises two said second rows of trays generally parallel to each other and said first row of trays, said second pusher alternately transfers trays from said first row to one and then the other of said second rows, and said fourth pusher alternately transfers trays from one and then the other of said second rows to said first row.

11. The pusher furnace of claim 10 wherein the chamber also comprises a barrier disposed generally parallel to and between said first row and said second rows of trays to facilitate uniformity of heating of workpieces carried by the trays and for separation of the atmosphere from one side of the barrier to the other.

12. The pusher furnace of claim 1 wherein said workpiece loader comprises first gripper jaws for engaging a workpiece and placing the workpiece on an empty tray in the chamber.

13. The pusher of claim 12 wherein said workpiece unloader comprises second gripper jaws for engaging a heated workpiece and removing the heated workpiece from a tray in the chamber.

14. The pusher of claim 1 wherein said workpiece unloader comprises gripper jaws for engaging a heated workpiece and removing the heated workpiece from a tray in the chamber.

15. The pusher furnace of claim 4 wherein said workpiece loader comprises first gripper jaws for engaging a workpiece and placing the workpiece on an empty tray in the chamber.

16. The pusher of claim 15 wherein said workpiece unloader comprises second gripper jaws for engaging a heated workpiece and removing the heated workpiece from a tray in the chamber.

17. The pusher of claim 4 wherein said workpiece unloader comprises gripper jaws for engaging a heated workpiece and removing the heated workpiece from a tray in the chamber.

* * * * *